US008571688B2

(12) United States Patent
Coward

(10) Patent No.: US 8,571,688 B2
(45) Date of Patent: Oct. 29, 2013

(54) SYSTEM AND METHOD FOR OPTIMIZATION OF GAS LIFT RATES ON MULTIPLE WELLS

(75) Inventor: Brian A. Coward, Southhampton (GB)

(73) Assignee: Honeywell International Inc., Morristown, NJ (US)

( * ) Notice: Subject to any disclaimer, the term of this patent is extended or adjusted under 35 U.S.C. 154(b) by 1337 days.

(21) Appl. No.: 11/440,750

(22) Filed: May 25, 2006

(65) Prior Publication Data

US 2007/0276542 A1 Nov. 29, 2007

(51) Int. Cl.
*G05B 13/00* (2006.01)
*E21C 41/24* (2006.01)

(52) U.S. Cl.
USPC ..... 700/28; 700/273; 702/12; 702/13; 166/372; 166/265

(58) Field of Classification Search
USPC ..... 700/273; 702/12, 13; 166/372, 166/265–268, 244.1, 400, 401
See application file for complete search history.

(56) References Cited

U.S. PATENT DOCUMENTS

| | | | | |
|---|---|---|---|---|
| 3,763,658 | A | 10/1973 | Gaumer, Jr. et al. | |
| 4,685,522 | A | 8/1987 | Dixon et al. | |
| 6,236,894 | B1 | 5/2001 | Stoisits et al. | |
| 6,272,882 | B1 | 8/2001 | Hodges et al. | |
| 6,434,435 | B1 | 8/2002 | Tubel et al. | |
| 6,454,002 | B1 | 9/2002 | Stokes et al. | |
| 6,793,712 | B2 | 9/2004 | Qualls | |
| 6,950,711 | B2 | 9/2005 | Havener et al. | |
| 6,964,181 | B1 | 11/2005 | Milios et al. | |
| 2002/0165671 | A1 * | 11/2002 | Middya | 702/12 |
| 2004/0216514 | A1 | 11/2004 | Nunnally et al. | |
| 2004/0244415 | A1 | 12/2004 | Paradowski | |
| 2004/0255615 | A1 | 12/2004 | Hupkes et al. | |
| 2005/0252222 | A1 | 11/2005 | Jessen et al. | |
| 2005/0284176 | A1 | 12/2005 | Eaton et al. | |
| 2007/0012072 | A1 | 1/2007 | Qualls et al. | |
| 2007/0227187 | A1 | 10/2007 | Coward | |
| 2007/0275471 | A1 | 11/2007 | Coward | |

FOREIGN PATENT DOCUMENTS

| | | |
|---|---|---|
| WO | WO 00/00715 A1 | 1/2000 |
| WO | WO 2004/038535 | 5/2004 |
| WO | WO 2004/070569 | 8/2004 |

OTHER PUBLICATIONS

Palke, M. R., Nonlinear optimization of well production considering gas lift and phase behavior, 1996, Report to dept. of petroleum eng. of Stanford University, 135 pgs.*

B. Stenhouse, "Learnings on Sustainable Model-Based Optimisation—The Valhall Optimiser Field Trial", SPE International, Apr. 2006, 15 pages.

L. Saputelli, "Self-Learning Reservoir Management", Dec. 2005 SPE Reservoir Evaluation & Engineering, pp. 534-547.

K.K.Lo, Optimum Lift-Gas Allocations Under Multiple Production Constraints, Society of Petroleum Engineers, vol. SPE, No. 26017, 1992, pp. 1-23.

(Continued)

*Primary Examiner* — In Suk Bullock
*Assistant Examiner* — Robert Eom

(57) ABSTRACT

A method includes controlling a lift-gas compression process, controlling a lift-gas extraction process, and controlling a production separation process. The method also includes receiving asset data and optimizing the lift-gas compression process, the lift-gas injection process, and the production separation process according to the asset data.

20 Claims, 4 Drawing Sheets

(56) References Cited

OTHER PUBLICATIONS

Saputelli, L.A. et al., Promoting Real-Time Optimization of Hydrocarbon Producting Systems, SPE Annual Technical Conference, vol. SPE 83978, Sep. 2, 2003, pp. 1-9.

"A Novel Approach Taking the Phillips Optimized Cascade LNG Process Into the Future," ConocoPhillips, AIChE 2003 Spring National Meeting, Apr. 2003, 29 pages.

Poster insert, Hydrocarbon Magazine, 2004, 1 page.

Atlantic LNG brochure, 2 pages.

* cited by examiner

100

SYSTEM AND METHOD FOR OPTIMIZATION OF GAS LIFT RATES ON MULTIPLE WELLS

TECHNICAL FIELD

This disclosure relates generally to process control systems and more particularly to a system and method for optimization of gas lift rates on multiple wells.

BACKGROUND

Gas lifting is an upstream production activity which involves the pumping of gas through a pipework annulus to inject it into a mandrel on a riser between a wellhead and processing equipment. The gas is of a lower density than the medium into which it is injected and thus effectively lowers the density of the material in the riser. This injection therefore lowers the pressure required to "lift" the resulting material blend to the surface and promotes increased production, by up to 50% in some cases. Because the gas injected returns to the process with the additional production, it is effectively a recycle stream. Therefore, increasing the gas lift by 1,000 standard cubic feet of additional gas will result in 1,000+x standard cubic feet returning through the process.

This means that, although increasing the gas liftrate increases the production, it also increases the loading on the compression system. There is a limitation on the benefits of gas lifting a well. If the gas lift rate is increased too far, then the production will drop because the gas rate is actually throttling the production riser since the physical volume of material flowing through the pipeline creates a high pressure drop.

When there are multiple risers being gas lifted, the determination of the optimal amount of gas lift per well is extremely difficult. The dynamic constraints of the ambient temperature, gas density and back pressure on the pipeline all affect the capacity of the compression system. Coupling the dynamic capacity of the compression process with the determination of the optimal gas lift rate for each well and implementing the closest feasible optimum has not been possible previously. Moreover, over or under injecting gas into the wells can cause a reduction in the production rate of hydrocarbons, losing opportunity and decreasing the overall economic viability of the production site.

SUMMARY

This disclosure provides a system and method for optimization of gas lift rates on multiple wells.

In a first embodiment, a method includes controlling a lift-gas compression process, controlling a lift-gas extraction process, and controlling a production separation process. The method also includes receiving asset data and optimizing the lift-gas compression process, the lift-gas extraction process, and the production separation process according to the asset data.

In a second embodiment, a computer program is embodied in a computer readable medium. The computer program includes computer readable program code for controlling a lift-gas compression process, controlling a lift-gas extraction process, and controlling a production separation process. The computer program also includes computer readable program code for receiving asset data and optimizing the lift-gas compression process, the lift-gas extraction process, and the production separation process according to the asset data.

In a third embodiment, a system includes a lift-gas compression process control system, a lift-gas extraction process control system, and a production separation process control system. The system also includes a production process control system including a multivariable controller configured to concurrently control and optimize the lift-gas compression process control system, the lift-gas extraction process control system, and the production separation process according to asset data.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
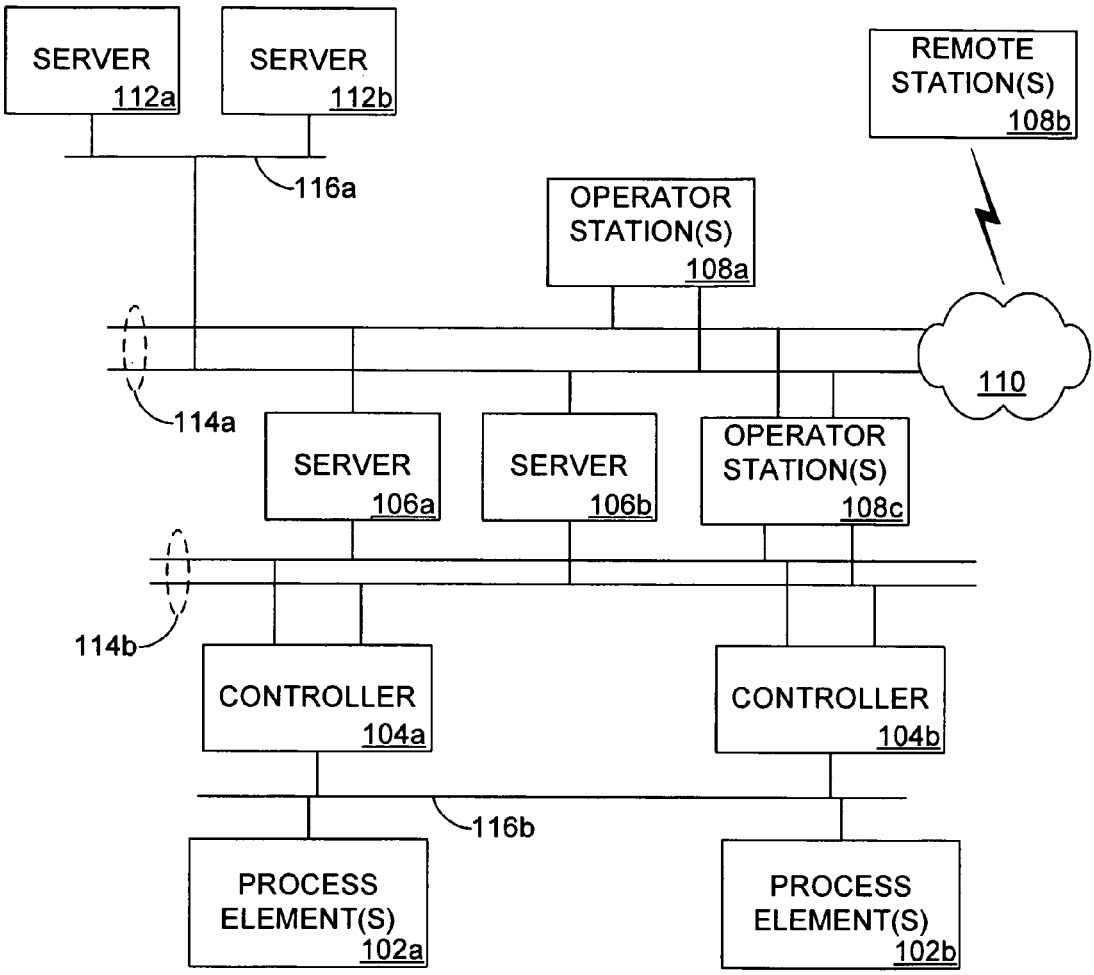
FIG. 1 illustrates an example process control system according to one embodiment of this disclosure.

FIG. 1 illustrates an example process control system 100 according to one embodiment of this disclosure. The embodiment of the process control system 100 shown in FIG. 1 is for illustration only. Other embodiments of the process control system 100 may be used without departing from the scope of this disclosure.

In this example embodiment, the process control system 100 includes one or more process elements 102*a*-102*b*. The process elements 102*a*-102*b* represent components in a process or production system that may perform any of a wide variety of functions. For example, the process elements 102*a*-102*b* could represent motors, catalytic crackers, valves, and other industrial equipment in a production environment. The process elements 102*a*-102*b* could represent any other or additional components in any suitable process or production system. Each of the process elements 102*a*-102*b* includes any hardware, software, firmware, or combination thereof for performing one or more functions in a process or production system. While only two process elements 102*a*-102*b* are shown in this example, any number of process elements may be included in a particular implementation of the process control system 100.

Two controllers 104*a*-104*b* are coupled to the process elements 102*a*-102*b*. The controllers 104*a*-104*b* control the operation of the process elements 102*a*-102*b*. For example, the controllers 104*a*-104*b* could be capable of monitoring the operation of the process elements 102*a*-102*b* and providing control signals to the process elements 102*a*-102*b*. Each of the controllers 104*a*-104*b* includes any hardware, software, firmware, or combination thereof for controlling one or more of the process elements 102*a*-102*b*. The controllers 104*a*-104*b* could, for example, include processors 105 of the POWERPC processor family running the GREEN HILLS INTEGRITY operating system or processors 105 of the X86 processor family running a MICROSOFT WINDOWS operating system.

Two servers 106*a*-106*b* are coupled to the controllers 104*a*-104*b*. The servers 106*a*-106*b* perform various functions to support the operation and control of the controllers 104*a*-104*b* and the process elements 102*a*-102*b*. For example, the servers 106*a*-106*b* could log information collected or generated by the controllers 104*a*-104*b*, such as status information related to the operation of the process elements 102*a*-102*b*. The servers 106*a*-106*b* could also execute applications that control the operation of the controllers 104*a*-104*b*, thereby controlling the operation of the process elements 102*a*-102*b*. In addition, the servers 106*a*-106*b* could provide secure access to the controllers 104*a*-104*b*. Each of the servers 106*a*-106*b* includes any hardware, software, firmware, or combination thereof for providing access to or control of the controllers 104*a*-104*b*. The servers 106*a*-106*b* could, for example, represent personal computers (such as desktop computers) executing a MICROSOFT WINDOWS operating system. As another example, the servers 106*a*-106*b* could include processors of the POWERPC processor family running the GREEN HILLS INTEGRITY operating system or processors of the X86 processor family running a MICROSOFT WINDOWS operating system.

One or more operator stations 108*a*-108*b* are coupled to the servers 106*a*-106*b*, and one or more operator stations 108*c* are coupled to the controllers 104*a*-104*b*. The operator stations 108*a*-108*b* represent computing or communication devices providing user access to the servers 106*a*-106*b*, which could then provide user access to the controllers 104*a*-104*b* and the process elements 102*a*-102*b*. The operator stations 108*c* represent computing or communication devices providing user access to the controllers 104*a*-104*b* (without using resources of the servers 106*a*-106*b*). As particular examples, the operator stations 108*a*-108*c* could allow users to review the operational history of the process elements 102*a*-102*b* using information collected by the controllers 104*a*-104*b* and/or the servers 106*a*-106*b*. The operator stations 108*a*-108*c* could also allow the users to adjust the operation of the process elements 102*a*-102*b*, controllers 104*a*-104*b*, or servers 106*a*-106*b*. Each of the operator stations 108*a*-108*c* includes any hardware, software, firmware, or combination thereof for supporting user access and control of the system 100. The operator stations 108*a*-108*c* could, for example, represent personal computers having displays and processors executing a MICROSOFT WINDOWS operating system.

In this example, at least one of the operator stations 108*b* is remote from the servers 106*a*-106*b*. The remote station is coupled to the servers 106*a*-106*b* through a network 110. The network 110 facilitates communication between various components in the system 100. For example, the network 110 may communicate Internet Protocol (IP) packets, frame relay frames, Asynchronous Transfer Mode (ATM) cells, or other suitable information between network addresses. The network 110 may include one or more local area networks (LANs), metropolitan area networks (MANs), wide area networks (WANs), all or a portion of a global network such as the Internet, or any other communication system or systems at one or more locations.

In this example, the system 100 also includes two additional servers 112*a*-112*b*. The servers 112*a*-112*b* execute various applications to control the overall operation of the system 100. For example, the system 100 could be used in a processing or production plant or other facility, and the servers 112*a*-112*b* could execute applications used to control the plant or other facility. As particular examples, the servers 112*a*-112*b* could execute applications such as enterprise resource planning (ERP), manufacturing execution system (MES), or any other or additional plant or process control applications. Each of the servers 112*a*-112*b* includes any hardware, software, firmware, or combination thereof for controlling the overall operation of the system 100.

As shown in FIG. 1, the system 100 includes various redundant networks 114*a*-114*b* and single networks 116*a*-116*b* that support communication between components in the system 100. Each of these networks 114*a*-114*b*, 116*a*-116*b* represents any suitable network or combination of networks facilitating communication between components in the system 100. The networks 114*a*-114*b*, 116*a*-116*b* could, for example, represent Ethernet networks. The process control system 100 could have any other suitable network topology according to particular needs.

Although FIG. 1 illustrates one example of a process control system 100, various changes may be made to FIG. 1. For example, a control system could include any number of process elements, controllers, servers, and operator stations.

Figure 2:
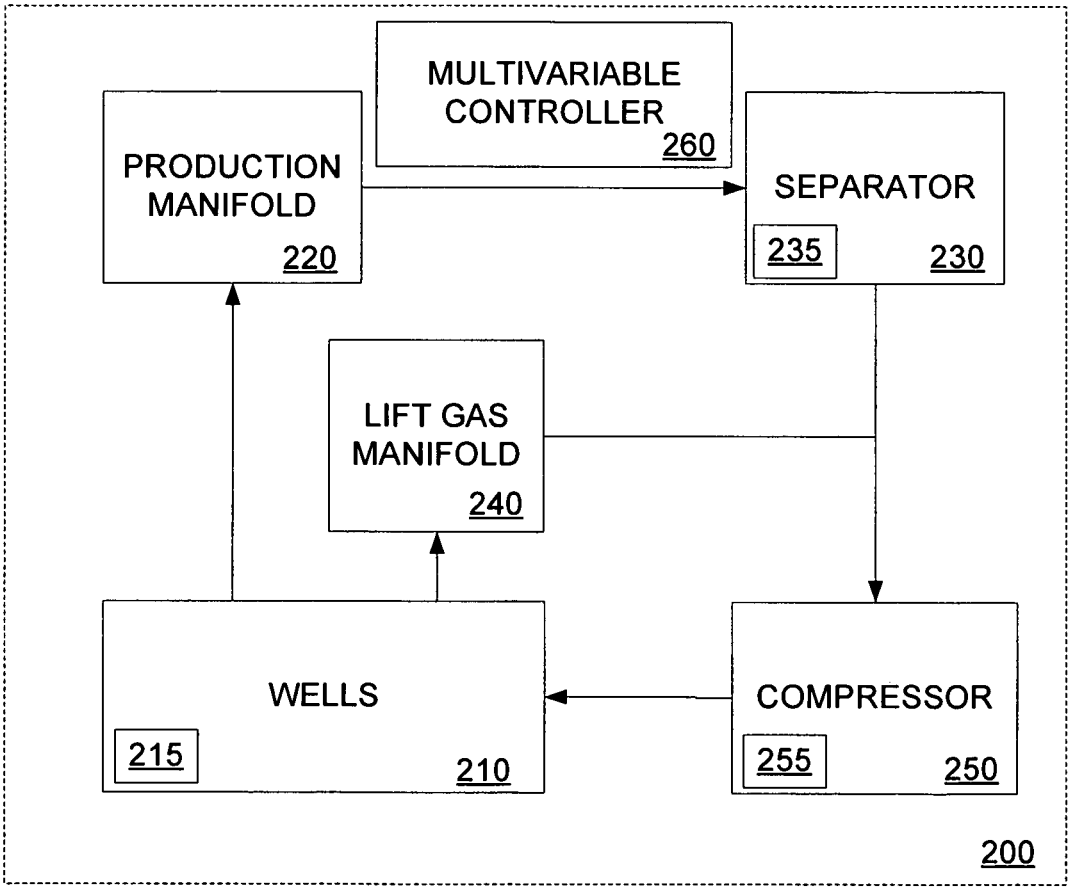
FIG. 2 illustrates an example process control system for a gas-lift process according to one embodiment of this disclosure.

FIG. 2 illustrates an example process control system 200 for a gas-lift process according to one embodiment of this disclosure. The embodiment of the process control system 200 shown in FIG. 2 is for illustration only. Other embodiments of the process control system 200 may be used without departing from the scope of this disclosure.

In an oil production process, operational throughput constraints are typically defined by either a compressor or the motor or turbine driving it. When gas lifting production wells, the amount of gas available for use in lifting and the pressure of the gas supplied are dependant upon the compressors in the process. As conditions on the process change, such as pressure in the separator or ambient temperature, the ability of the compressor to supply gas at different rates and pressures varies. The optimal use of this gas for lifting is therefore important since it impacts the amount of oil that is produced from a reservoir.

Conventional software packages can calculate the optimum pressure and amount of gas that should be used to lift each well, solving for a steady state solution. Although this approach adds value, these conventional approaches cannot utilize opportunistic capacity.

In a system in accordance with a disclosed embodiment, the application of multivariable control to the control of the gas lift enables the steady state solution from an off-line package to be implemented in real-time, closed loop control, exploiting dynamic process changes to enable increased production.

An application can be configured to run and control a particular section of an operating process and can be configured to maximize profit, quality, production, or other objectives. Each application may be configured with manipulated variables (MV), controlled variables (CV), disturbance variables (DV), and a control horizon over which to ensure that the variables are brought inside limits specified by the operator. A controlled variable represents a variable that a controller attempts to maintain within a specified operating range or otherwise control. A manipulated variable represents a variable manipulated by the controller to control a controlled variable. A disturbance variable represents a variable that affects a controlled variable but that cannot be controlled by the controller.

Disclosed embodiments may consider optimization in terms of finding the best solution within a system's physical and financial constraints. In gas-lift, one particular solution involves producing the maximum sales volumes within the physical constraints imposed by the reservoir, well, facilities, and financial constraints such as fuel cost or budget expenditure. The variables in various embodiments can include controlled variables (such as flowrate), manipulated variables (such as choke position, separator inlet pressure, and compressor discharge pressure), disturbance variables (such as water cut, reservoir pressure, and air temperature), and any target values (TV) for the process.

One objective of some embodiments is therefore to optimize the system by adjusting the manipulated variables to maintain the controlled variables as close to the target values as possible, while minimizing the impact of disturbance variable variance.

In practice, production operators manage the process by changing the manipulated variables based on experience and periodically updated target values. These target values are typically provided by engineering recommendations following analysis of current reservoir and operating conditions. Target values are typically updated and implemented periodically, such as every three months, and consequently do not consistently reflect the process drift and disturbances, which change at a much higher frequency. Therefore, any asset with target values, including any process element or controlled mechanical or electromechanical element, that do not incorporate up-to-date disturbances, is likely to be sub-optimal.

As shown in FIG. 2, a process control system 200 for a gas-lift process is disclosed in accordance with one embodiment, which includes gas-lift loop interactions. Here, compressor 250 injects lift gas into wells 210. Compressor 250 can be powered by a fuel gas from an external fuel supply or in any other suitable manner. Compressor 250 can be controlled by a lift-gas compression process control system 255. The lift gas produced by wells 210 is passed to lift gas manifold 240, and thereafter returned to compressor 250 to be reused.

The liquid production of wells 210 is passed to production manifold 220 and then to separator 230. Water and oil are separated at separator 230 and then stored or further processed, while any separated lift gas is returned to compressor 250 to be reused. The process at the wells 210, production manifold 220 and lift gas manifold 240 can be controlled by a lift-gas extraction process control system 215. The separator 230 can be controlled by a production separation process control system 235.

This simplified diagram does not include each individual compressor, pump, valve, switch, and other mechanical and electromechanical process elements used in the process. Such elements and their use in a gas lift system are known to those of skill in the art.

The compressor 250, wells 210, lift gas manifold 240, production manifold 220, and separator 230 can each include multiple process elements and one or more process controllers, as described above with relation to FIG. 1, that optimize the processes and variables as described herein. Each of these is further connected to communicate with and be controlled by multivariable controller 260, as described herein, although these connections are not shown in FIG. 2 for sake of clarity.

While the process control system 200 depicted in FIG. 2 is drawn to a natural gas and oil production facility for purposes of illustration of the techniques described herein, the process optimization techniques discussed herein can also be applied to other hydrocarbon production facilities as will be understood by those of skill in the art.

To implement an optimization solution in FIG. 2, two forms of technology may be used. For steady-state gas-lift system optimization, a global optimization may be achieved when the combined equipment, including the wells, separator, and compressor, are operating as close to the total system constraints as possible. This may require a robust and integrated asset model linked to real-time data. The solution may be capable of optimizing a non-linear, unconstrained optimization solution and be able to extract from that ideal resting values and relative economics (preferential give-up order).

Various embodiments include, in addition to optimization of the reservoir-to-separator production system as far as the separator, an optimization system that also integrates the compressors and the gas distribution network, which gets the gas from the separator back to the wellheads. Such a system thereby optimizes the complete gas lift loop.

The compressor suction pressure is related to the separator pressure, which in turn is related to the wellhead pressures. The pressures are connected by the pressure drops in the connecting pipe work, and the wellhead pressures affect how much lift gas is required to obtain the maximum benefit from an individual well.

Similarly, the highest casing head pressure (CHP) among the wells controls the minimum compressor discharge pressure. Finally, the compressor suction and discharge pressures control the maximum compressor throughput and therefore the lift gas available and also the fuel gas requirement. Higher values of suction pressure and lower values of discharge pressure increase the maximum compressor throughput. Therefore, for example, reducing separator pressure increases the production from the wells and reduces the lift gas requirement but reduces the maximum compressor throughput. Disclosed embodiments consider the total system to find the optimal trade-offs between these conflicting effects. When global optimization is obtained, all the equipment is at its optimum setting to achieve maximum total system production.

For non steady-state or dynamic optimization, sustaining global optimization may be performed by monitoring deviations between the target values and the process, then implementing changes to the base level controllers to ensure that the process remains as close to the target values as possible. This may be achieved through the use of model-based predictive control. The target value solution may not always be feasible, as, for example, increasing ambient temperature decreases the performance and capability of the turbine and therefore the capacity of the compressor. Therefore, an application may be able to implement the closest feasible solution, derived from the current process position and the quadratic optimization coefficients.

Sustaining the benefits of steady state optimization may be a major challenge. The process varies continually and upsets the separator-compressor balance, and thus optimization gains are lost. Also, as the production system is dynamic, the optimal settings at one point in time will rapidly become sub-optimal. Various embodiments include a solution to reduce the time taken to complete the optimization and implementation cycles.

One embodiment of this optimization uses a dynamic online multivariable control and optimization technology. This enables dynamic control of the process to ensure that the operating conditions are always as close as feasible to the ideal steady state values while honoring constraints and limits on the process.

Figure 3:
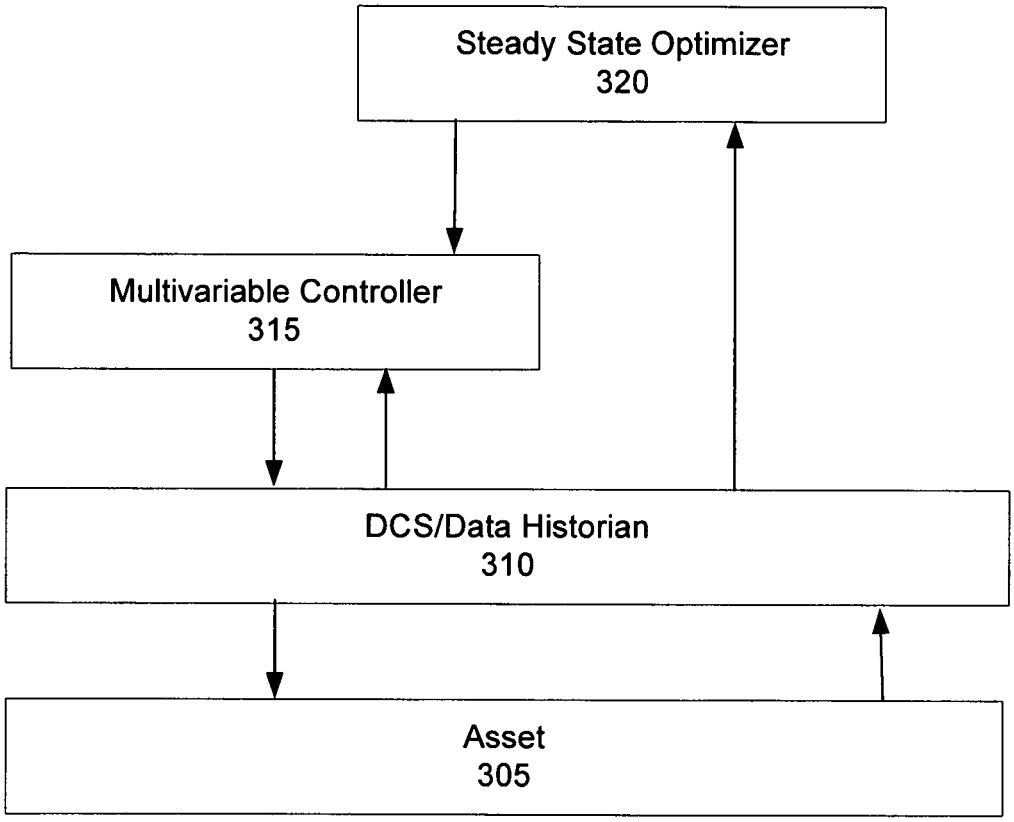
FIG. 3 illustrates an example integrated optimization architecture according to one embodiment of this disclosure.

FIG. 3 illustrates an example integrated optimization architecture according to one embodiment of this disclosure. Considering the steady state work flow first, daily asset data (equipment constraints, configuration parameters, commercial objectives, oil price, etc.) is acquired from asset 305 by the DCS/Data Historian 310. This data is then transmitted to a steady-state optimizer 320. The steady-state optimizer 320 then calculates the optimal target values and transmits them to a multivariable controller 315, which uses them as the ideal resting values for the process. Based on internal models of the process, the multivariable controller 315 then manipulates the setpoints of base controllers to ensure that the process follows the optimal feasible trajectory to attain and remain at the new resting values.

In particular embodiments, to ensure that the application utilizes any degrees of freedom to increase profitability or other defined objectives, the application may be configured with either linear program (LP) economics or quadratic program (QP) economics. These two different economic optimization approaches use a minimization strategy described below, and the quadratic optimization also uses ideal resting values (or desired steady state values). The general form of an objective function is:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2,$$

where:

$b_i$ represents the linear coefficient of the $i^{th}$ controlled variable;

$b_j$ represents the linear coefficient of the $j^{th}$ manipulated variable;

$a_i$ represents the quadratic coefficient of the $i^{th}$ controlled variable;

$a_j$ represents the quadratic coefficient of the $j^{th}$ manipulated variable;

$CV_i$ represents the actual resting value of the $i^{th}$ controlled variable; and $CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

As shown here, the optimization for each application can be complex since the scope of an application may contain upwards of twenty variables, each able to be incorporated into either a linear or quadratic optimization objective. Given that the production process may be sequential and that altering the limits on a product quality or rate on one application may affect another application, there is coordination between the various applications.

The following represents examples of how the various applications in the various process control systems may operate alone or in combination. These examples are for illustration and explanation only. The various applications could perform any other or additional operations according to particular needs.

Multivariable Controller Design: The design of the multivariable controller that will dynamically optimize the gas lift rates is shown below in general form. The multivariable controller and its operating software may accept the optimal gas lift rate as a quadratic optimization target for each of the gas lift rates, together with the relative economics on each of the rates. Gains may be extractable for the relationships between the gas lift rate and the production increase to enable the optimal solution to be implemented.

The manipulated variables for this application would be the following:

| | |
|---|---|
| Number of wells - gas flow lift controllers | The flow controllers will either be running in manual or automatic. In automatic, a setpoint for the gas lift rate would be sent to the base controller, while in manual a valve position would be sent. In manual, the gas lift flow would be a controlled variable. |
| Compressor discharge pressure | Depending upon the performance controls of the compressor, this could be the suction pressure or discharge pressure. |
| Compressor speed | Depending upon the configuration of the compressor, the speed may be available as a potential manipulated variable. |

The multivariable controller matrix may also include at least the following controlled variables. Additional constraints may be added depending upon operational subtleties in the different processes, as will be recognized by those of skill in the art.

| | |
|---|---|
| Number of gas lift flow controllers - gas lift flow controller valve position | Depending on the mode of the gas lift flow controller, this could be the position of the flow controller or the actual gas lift flow. If a flow then these values will have an ideal target sent from the steady state optimizer, together with economic values. |
| Suction pressure of compressor | Depending on the performance control configuration, this may be discharge pressure, but this is typically an operational constraint. |
| Wellhead pressures | This pressure is the constraint on the compressor throughput. Where this can be reduced, the compressor throughput can be increased. Ideal target for this value is sent from the steady-state optimizer. |
| Crude production rate | Product value optimization target, this is the variable that the application preferably intends to continually maximize. |
| Compressor proximity to surge/stonewall | Dynamic constraint for the gas lift rate limitation. This indicates that the compressor has reached an operational limit. |
| Gas turbine exhaust gas temperature | Constraint on the operation, where a gas turbine is used as the driver. This could be the current to the motor for an electrically-driven compressor. |
| Compressor suction valve position | Constraint on compressor operation - this variable indicates that there is or isn't potential to increase the gas lift rate. |
| Compressor recycle valve position | Constraint on compressor operation - this variable indicates that there is or isn't potential to increase the gas lift rate. |

-continued

| | |
|---|---|
| Recycle gas rate | Indication on the returned gas rate that will be experienced by the compressor where the gas rate is increased. |

The application can also be configured with disturbance variables, but these are specific to specific implementations, as will be recognized by those of skill in the art. Because they are not generic, they may not be generally stated.

Figure 4:
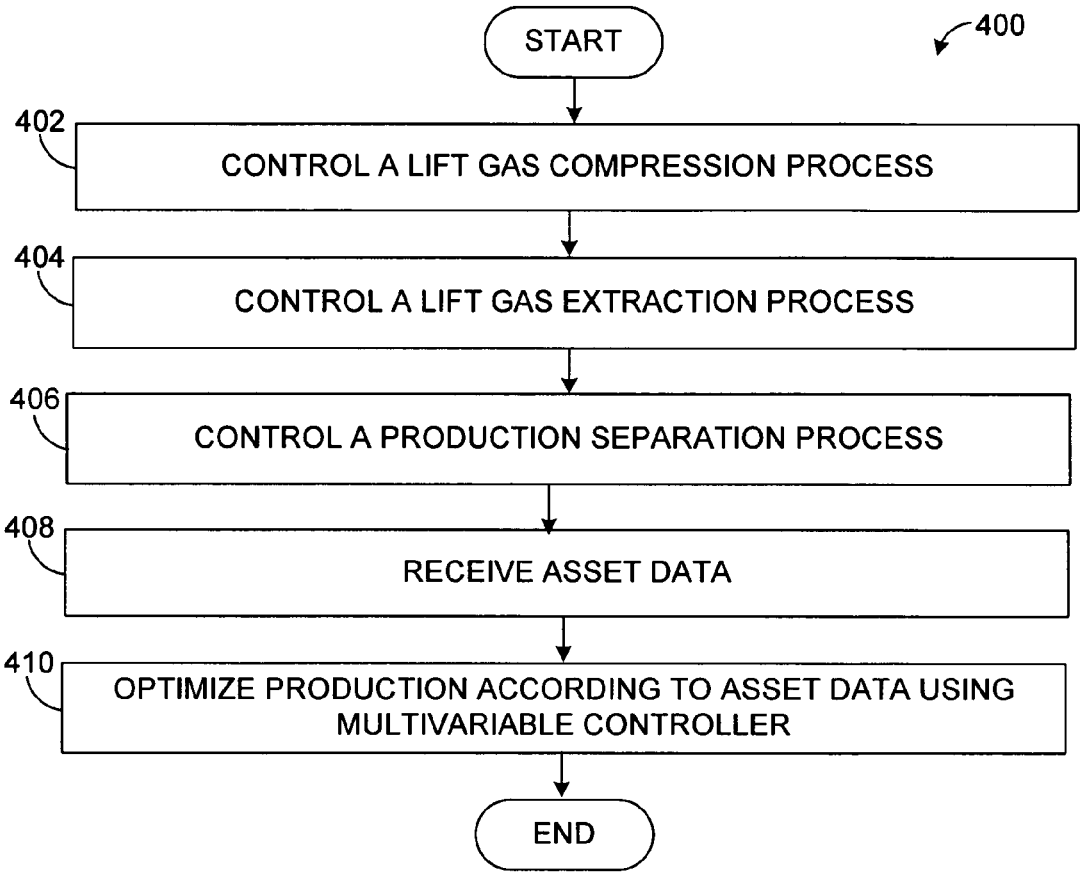
FIG. 4 illustrates an example method for optimization of gas lift rates on multiple wells according to one embodiment of this disclosure.

FIG. 4 illustrates an example method for optimization of gas lift rates on multiple wells according to one embodiment of this disclosure.

One step includes controlling a lift-gas compression process at step 402 for compressing lift gas. This control process can include controlling and compensating for particular manipulated variables, controlled variables, and disturbance variables as described above. The lift-gas compression process can be controlled using a lift-gas compression process control system.

Another step includes controlling a lift-gas extraction process at step 404 for injecting compressed lift-gas into wells to increase extraction and production from the wells. This control process can include controlling and compensating for particular manipulated variables, controlled variables, and disturbance variables as described above. The lift-gas extraction process can be controlled using a lift-gas extraction process control system.

Another step includes controlling a production separation process at step 406 to separate the extraction product into oil, water, lift gas, and other components. This control process can include controlling and compensating for particular manipulated variables, controlled variables, and disturbance variables as described above. Typically, the lift gas is returned to the lift-gas compression process. The production separation process can be controlled using a production separation process control system.

Another step includes receiving asset data at step 408. The asset data can include equipment constraints, configuration parameters, commercial objectives, oil price, etc. In some embodiments, this asset data is collected from a data historian processor that defines or describes current asset information or objectives.

Another step includes optimizing the lift-gas compression process, the lift-gas extraction process, and the production separation process according to the asset data at step 410. For example, these processes, along with their respective manipulated variables, controlled variables, and disturbance variables may be controlled together to optimize at least one objective according to the asset data. Objectives can include, for example, maximum oil production or maximum process profit. The optimization can be performed using a production process control system including a multivariable controller 260 that can concurrently control and optimize the lift-gas compression process control system 255, the lift-gas extraction process control system 215, and the production separation process control system 235.

Although FIG. 4 illustrates one example of a method 400 for lift gas production and optimization, various changes may be made to FIG. 4. For example, one, some, or all of the steps may occur as many times as needed. Also, while shown as a sequence of steps, various steps in FIG. 4 could occur in parallel or in a different order. As a particular example, all steps shown in FIG. 4 could be performed in parallel.

In some embodiments, the various functions performed in conjunction with the systems and methods disclosed herein are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The term "application" refers to one or more computer programs, sets of instructions, procedures, functions, objects, classes, instances, or related data adapted for implementation in a suitable computer language. The terms "include" and "comprise," as well as derivatives thereof, mean inclusion without limitation. The term "or" is inclusive, meaning and/or The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method, comprising:

controlling a lift-gas compression process associated with multiple wells using a lift-gas compression process control system, the lift-gas compression process comprising a compressor that compresses a lift gas for injection of compressed lift gas between wellheads and processing equipment to facilitate lifting of material from one or more reservoirs associated with the wells;

controlling a lift-gas extraction process associated with the multiple wells using a lift-gas extraction process control system;

controlling a production separation process using a production separation process control system, the production separation process comprising a separator, wherein operation of the separator in the production separation process affects operation of the compressor in the lift-gas compression process;

receiving process-related data associated with at least one of: one or more of the processes and the material from the one or more reservoirs; and optimizing the lift-gas compression process control system, the lift-gas extraction process control system, and the production separation process control system based on the process-related data, wherein the optimizing comprises optimizing a gas lift rate for each of the wells by accepting an optimal gas lift rate as a quadratic optimization target for each gas lift rate, the quadratic optimization target determined based on differences between actual and desired resting values of multiple controlled variables and multiple manipulated variables;

wherein the processing equipment includes equipment performing the lift-gas extraction process and the production separation process; and wherein the manipulated variables include a number of wells, a compressor discharge pressure, and a compressor speed.

2. The method of claim 1, wherein the process-related data includes at least one of: equipment constraints, configuration parameters, commercial objectives, and product price.

3. The method of claim 1, wherein the optimizing is performed using a multivariable controller that receives target values from a steady-state optimizer, the multivariable controller operating to adjust the manipulated variables to cause the controlled variables to approach the target values.

4. The method of claim 1, wherein the controlled variables include a number of gas lift flow controllers or gas lift flow controller valve positions, a suction pressure of the compressor, wellhead pressures, a crude production rate, a compressor proximity to surge, and a compressor motor current or a gas turbine exhaust gas temperature.

5. The method of claim 4, wherein the controlled variables further include a compressor suction valve position, a compressor recycle valve position, and a recycle gas rate.

6. A method, comprising:

controlling a lift-gas compression process associated with multiple wells using a lift-gas compression process control system, the lift-gas compression process comprising a compressor that compresses a lift gas for injection to facilitate lifting of material from one or more reservoirs associated with the wells;

controlling a lift-gas extraction process associated with the multiple wells using a lift-gas extraction process control system;

controlling a production separation process using a production separation process control system, the production separation process comprising a separator, wherein operation of the separator in the production separation process affects operation of the compressor in the lift-gas compression process;

receiving process-related data associated with at least one of: one or more of the processes and the material from the one or more reservoirs; and optimizing the lift-gas compression process control system, the lift-gas extraction process control system, and the production separation process control system based on the process-related data, wherein the optimizing comprises optimizing a gas lift rate for each of the wells by accepting an optimal gas lift rate as a quadratic optimization target for each gas lift rate, the quadratic optimization target determined based on differences between actual and desired resting values of one or more controlled variables and one or more manipulated variables;

wherein the quadratic optimization target for each gas lift rate is determined according to a function of:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2$$

where:

$b_i$ represents a linear coefficient of an $i^{th}$ controlled variable;

$b_j$ represents a linear coefficient of a $j^{th}$ manipulated variable;

$a_i$ represents a quadratic coefficient of the $i^{th}$ controlled variable;

$a_j$ represents a quadratic coefficient of the $j^{th}$ manipulated variable;

$CV_i$ represents the actual resting value of the $i^{th}$ controlled variable;

$CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

7. A non-transitory computer readable medium embodying a computer program, the computer program comprising computer readable program code for:

controlling a lift-gas compression process associated with multiple wells using a lift-gas compression process control system, the lift-gas compression process comprising a compressor that compresses a lift gas for injection of compressed lift gas between wellheads and processing equipment to facilitate lifting of material from one or more reservoirs associated with the wells;

controlling a lift-gas extraction process associated with the multiple wells using a lift-gas extraction process control system;

controlling a production separation process using a production separation process control system, the production separation process comprising a separator, wherein operation of the separator in the production separation process affects operation of the compressor in the lift-gas compression process;

receiving process-related data associated with at least one of: one or more of the processes and the material from the one or more reservoirs; and optimizing the lift-gas compression process control system, the lift-gas extraction process control system, and the production separation process control system based on the process-related data;

wherein the computer readable program code for optimizing comprises computer readable program code for optimizing a gas lift rate for each of the wells by accepting an optimal gas lift rate as a quadratic optimization target for each gas lift rate, the quadratic optimization target based on differences between actual and desired resting values of multiple controlled variables and multiple manipulated variables;

wherein the processing equipment includes equipment performing the lift-gas extraction process and the production separation process; and wherein the manipulated variables include a number of wells, a compressor discharge pressure, and a compressor speed.

8. The computer readable medium of claim 7, wherein the process-related data includes at least one of: equipment constraints, configuration parameters, commercial objectives, and product price.

9. The computer readable medium of claim 7, wherein the computer program is executed by a multivariable controller.

10. The computer readable medium of claim 7, wherein the controlled variables include a number of gas lift flow controllers or gas lift flow controller valve positions, a suction pressure of the compressor, wellhead pressures, a crude production rate, a compressor proximity to surge, and a compressor motor current or a gas turbine exhaust gas temperature.

11. The computer readable medium of claim 10, wherein the controlled variables further include a compressor suction valve position, a compressor recycle valve position, and a recycle gas rate.

12. A non-transitory computer readable medium embodying a computer program, the computer program comprising computer readable program code for:

controlling a lift-gas compression process associated with multiple wells using a lift-gas compression process control system, the lift-gas compression process comprising a compressor that compresses a lift gas for injection to facilitate lifting of material from one or more reservoirs associated with the wells;

controlling a lift-gas extraction process associated with the multiple wells using a lift-gas extraction process control system;

controlling a production separation process using a production separation process control system, the production separation process comprising a separator, wherein operation of the separator in the production separation process affects operation of the compressor in the lift-gas compression process;

receiving process-related data associated with at least one of: one or more of the processes and the material from the one or more reservoirs; and optimizing the lift-gas compression process control system, the lift-gas extraction process control system, and the production separation process control system based on the process-related data;

wherein the computer readable program code for optimizing comprises computer readable program code for optimizing a gas lift rate for each of the wells by accepting an optimal gas lift rate as a quadratic optimization target for each gas lift rate, the quadratic optimization target based on differences between actual and desired resting values of one or more controlled variables and one or more manipulated variables; and wherein the quadratic optimization target for each gas lift rate is determined according to a function of:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2,$$

where:

$b_i$ represents a linear coefficient of the $i^{th}$ controlled variable;

$b_j$ represents a linear coefficient of the $j^{th}$ manipulated variable;

$a_i$ represents a quadratic coefficient of the $i^{th}$ controlled variable;

$a_j$ represents a quadratic coefficient of the $j^{th}$ manipulated variable;

$CV_i$ represents the actual resting value of the $i^{th}$ controlled variable;

$CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

13. A process control system, comprising:

a lift-gas compression process control system configured to control a lift-gas compression process associated with multiple wells, the lift-gas compression process comprising a compressor that compresses a lift gas for injection of compressed lift gas between wellheads and processing equipment to facilitate lifting of material from one or more reservoirs associated with the wells;

a lift-gas extraction process control system configured to control a lift-gas extraction process associated with the multiple wells;

a production separation process control system configured to control a production separation process, the production separation process comprising a separator, wherein operation of the separator in the production separation process affects operation of the compressor in the lift-gas compression process; and a production process control system including a multivariable controller configured to concurrently control and optimize the lift-gas compression process control system, the lift-gas extraction process control system, and the production separation process control system based on process-related data associated with at least one of: one or more of the processes and the material from the one or more reservoirs;

wherein the multivariable controller is configured to optimize the control systems by determining a gas lift rate for each of the wells, wherein the multivariable controller is operable to accept an optimal gas lift rate as a quadratic optimization target for each gas lift rate, the quadratic optimization target based on differences between actual and desired resting values of multiple controlled variables and multiple manipulated variables;

wherein the processing equipment includes equipment performing the lift-gas extraction process and the production separation process; and wherein the manipulated variables include a number of wells, a compressor discharge pressure, and a compressor speed.

14. The process control system of claim 13, wherein the process-related data includes at least one of: equipment constraints, configuration parameters, commercial objectives, and product price.

15. A process control system, comprising:

a lift-gas compression process control system configured to control a lift-gas compression process associated with multiple wells, the lift-gas compression process comprising a compressor that compresses a lift gas for injection of compressed lift gas between wellheads and processing equipment to facilitate lifting of material from one or more reservoirs associated with the wells;

a lift-gas extraction process control system configured to control a lift-gas extraction process associated with the multiple wells;

a production separation process control system configured to control a production separation process, the production separation process comprising a separator, wherein operation of the separator in the production separation process affects operation of the compressor in the lift-gas compression process; and a production process control system including a multivariable controller configured to concurrently control and optimize the lift-gas compression process control system, the lift-gas extraction process control system, and the production separation process control system based on process-related data associated with at least one of: one or more of the processes and the material from the one or more reservoirs;

wherein the multivariable controller is configured to optimize the control systems by determining a gas lift rate for each of the wells, wherein the multivariable controller is operable to accept an optimal gas lift rate as a quadratic optimization target for each gas lift rate, the quadratic optimization target based on differences between actual and desired resting values of multiple controlled variables and multiple manipulated variables;

wherein the processing equipment includes equipment performing the lift-gas extraction process and the production separation process; and wherein the controlled variables include a number of gas lift flow controllers or gas lift flow controller valve positions, a suction pressure of the compressor, wellhead pressures, a crude production rate, a compressor proximity to surge, and a compressor motor current or a gas turbine exhaust gas temperature.

16. The process control system of claim 15, wherein the controlled variables further include a compressor suction valve position, a compressor recycle valve position, and a recycle gas rate.

17. A process control system, comprising:

a lift-gas compression process control system configured to control a lift-gas compression process associated with multiple wells, the lift-gas compression process comprising a compressor that compresses a lift gas for injection to facilitate lifting of material from one or more reservoirs associated with the wells;

a lift-gas extraction process control system configured to control a lift-gas extraction process associated with the multiple wells;

a production separation process control system configured to control a production separation process, the production separation process comprising a separator, wherein operation of the separator in the production separation process affects operation of the compressor in the lift-gas compression process; and a production process control system including a multivariable controller configured to concurrently control and optimize the lift-gas compression process control system, the lift-gas extraction process control system, and the production separation process control system based on process-related data associated with at least one of: one or more of the processes and the material from the one or more reservoirs;

wherein the multivariable controller is configured to optimize the control systems by determining a gas lift rate for each of the wells, wherein the multivariable controller is operable to accept an optimal gas lift rate as a quadratic optimization target for each gas lift rate, the quadratic optimization target based on differences between actual and desired resting values of one or more controlled variables and one or more manipulated variables; and wherein the quadratic optimization target for each gas lift rate is determined according to a function of:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2,$$

where:

$b_i$ represents a linear coefficient of the $i^{th}$ controlled variable;

$b_j$ represents a linear coefficient of the $j^{th}$ manipulated variable;

$a_i$ represents a quadratic coefficient of the $i^{th}$ controlled variable;

$a_j$ represents a quadratic coefficient of the $j^{th}$ manipulated variable;

$CV_i$ represents the actual resting value of the $i^{th}$ controlled variable;

$CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

18. The method of claim 1, wherein the quadratic optimization target for each gas lift rate is determined according to a function of:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2$$

where:

$b_i$ represents a linear coefficient of an $i^{th}$ controlled variable;

$b_j$ represents a linear coefficient of a $j^{th}$ manipulated variable;

$a_i$ represents a quadratic coefficient of the $i^{th}$ controlled variable;

$a_j$ represents a quadratic coefficient of the $j^{th}$ manipulated variable;

$CV_i$ represents the actual resting value of the $i^{th}$ controlled variable;

$CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

19. The computer readable medium of claim 7, wherein the quadratic optimization target for each gas lift rate is determined according to a function of:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2,$$

where:

$b_i$ represents a linear coefficient of the $i^{th}$ controlled variable;

$b_j$ represents a linear coefficient of the $j^{th}$ manipulated variable;

$a_i$ represents a quadratic coefficient of the $i^{th}$ controlled variable;

$a_j$ represents a quadratic coefficient of the $j^{th}$ manipulated variable;

$CV_i$ represents the actual resting value of the $i^{th}$ controlled variable;

$CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

20. The process control system of claim 13, wherein the quadratic optimization target for each gas lift rate is determined according to a function of:

Minimize $$J = \sum_i b_i \times CV_i + \sum_i a_i^2 (CV_i - CV_{0i})^2 + \sum_j b_j \times MV_j + \sum_j a_{j2} (MV_j - MV_{0j})^2,$$

where:

$b_i$ represents a linear coefficient of the $i^{th}$ controlled variable;

$b_j$ represents a linear coefficient of the $j^{th}$ manipulated variable;

$a_i$ represents a quadratic coefficient of the $i^{th}$ controlled variable;

$a_j$ represents a quadratic coefficient of the $j^{th}$ manipulated variable;

$CV_i$ represents the actual resting value of the $i^{th}$ controlled variable;

$CV_{0i}$ represents the desired resting value of the $i^{th}$ controlled variable;

$MV_j$ represents the actual resting value of the $j^{th}$ manipulated variable; and $MV_{0j}$ represents the desired resting value of the $j^{th}$ manipulated variable.

* * * * *